United States Patent [19]

Balfour-Richie

[11] 4,317,244

[45] Mar. 2, 1982

[54] MATTRESS COVER FOR AN INFLATABLE AIR MATTRESS

[76] Inventor: Gordon A. Balfour-Richie, 50 St. Francis Way, Santa Barbara, Calif. 93105

[21] Appl. No.: 141,779

[22] Filed: Apr. 21, 1980

[51] Int. Cl.[3] ..... A47G 9/00; A47C 27/08

[52] U.S. Cl. ..... 5/449; 5/470; 5/482; 5/500

[58] Field of Search ..... 5/482, 475, 496, 497, 5/498, 449, 470, 471, 441, 450, 501, 500, 502

[56] References Cited

U.S. PATENT DOCUMENTS

| | | | |
|---|---|---|---|
| 2,823,394 | 2/1958 | Smith | 5/470 |
| 3,027,573 | 4/1962 | Bell | 5/470 |
| 3,251,075 | 5/1966 | Saltness et al. | 5/441 |
| 3,581,322 | 6/1971 | Marsico | 5/470 |
| 4,147,828 | 4/1979 | Heckel et al. | 5/420 |

*Primary Examiner*—Alexander Grosz
*Attorney, Agent, or Firm*—Jack C. Munro

[57] ABSTRACT

A mattress cover for an inflatable air mattress which completely encases the air mattress. The mattress cover is constructed of a plurality of layers of material. The layer of material in direct contact with the air mattress takes the form of a soft, smooth, cushiony material so as to substantially eliminate the creation of any noise between the mattress and the cover during usage of the mattress. The top layer of the cover includes a cushiony layer of material and the side wall of the cover includes a stiffing layer of material. The exterior most layer of the cover is constructed of a decorative fabric. The cover includes an enlarged access opening to facilitate entry and removal of the mattress from the internal compartment to the cover.

1 Claim, 5 Drawing Figures

MATTRESS COVER FOR AN INFLATABLE AIR MATTRESS

BACKGROUND OF THE INVENTION

The field of this invention relates to a mattress cover and more particularly to a mattress cover which is specifically designed to be used in combination with an inflatable mattress.

Innovation with respect to inflatable mattresses has reached a level when an inflatable air mattress can be constructed to be superior in comfort to a conventional mattress. Also, inflatable mattresses are now constructed to be extremely durable.

In the using of an inflatable mattress, it has been common to place bedclothes, such as sheets and blankets directly onto the mattress. This is undesirable because there is a lack of cushioning material on the mattresses, thus making the mattresses uncomfortable. Another undesirable aspect of the mattresses is that inherently each time the user moves on the mattress, there is relative movement between the bedclothes and the mattress manifesting itself in the form of a noise, similar to a high pitched squeek. Anyone attempting to sleep or rest on such a mattress and constantly being subjected to such a noise will find it very difficult to do so.

There is a definite need for a mattress cover for an inflatable air mattress which increases the comfortability of the mattress to the user and also eliminates creation of any noise between the mattress and the mattress cover.

SUMMARY OF THE INVENTION

The mattress cover of this invention takes the form of an enclosed housing which has an internal compartment into which is to be located the inflatable mattress. The housing includes an enlarged closable access opening through which the mattress is to be placed within the internal compartment and removed therefrom. The top surface of the mattress cover, the surface upon which the individual is to lay, is to be constructed to three different layers of material. The layer of material located against the mattress is to comprise a soft, smooth, non-abrasive fabric. The outermost layer of the top surface is to be constructed of a decorative fabric. In between the outermost layer and the inner layer there is cushioning material. These three layers of material are sewn together. The side wall assembly of the mattress cover is also constructed of multiple layers with a smooth, cushiony fabric or foam to be located directly adjacent the mattress. Secured to this smooth, cushiony layer is a stiffing layer of material so as to provide a certain amount of rigidity to the side wall assembly of the cover. The outermost layer of the side wall assembly also constitutes a decorative fabric. The bottom layer of material of the mattress cover will normally comprise a rayon acetate or polyester type of fabric which is to have texture and weave so as to have anti-slip qualities so as to be inherently frictionally grabbing when placed on a slippery supportive surface, such as a tile or a linoleum floor. This is to keep the mattress from being easily movable and to remain in the established position on the supportive surface.

The primary objective of this invention is to construct a mattress cover for an inflatable air mattress which prevents creation of any noise during usage of the mattress.

Another objective of this invention is to construct a mattress cover which substantially increases the comfort of the air mattress during usage.

Another objective of this invention is to construct a mattress cover which can be manufactured and sold relatively inexpensively.

and

Figure 1:
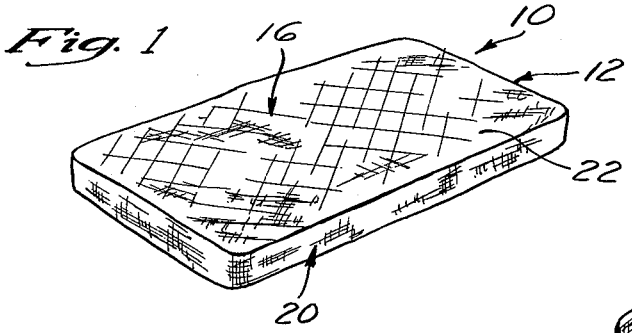
FIG. 1 is a top isometric view of an inflated mattress covered with the mattress cover of this invention.
Figure 2:
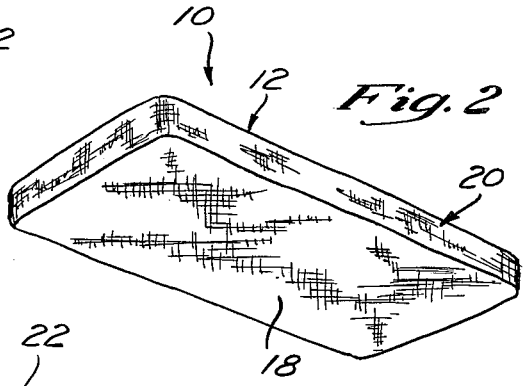
FIG. 2 is a bottom isometric view of the structure of FIG. 1.
Figure 3:
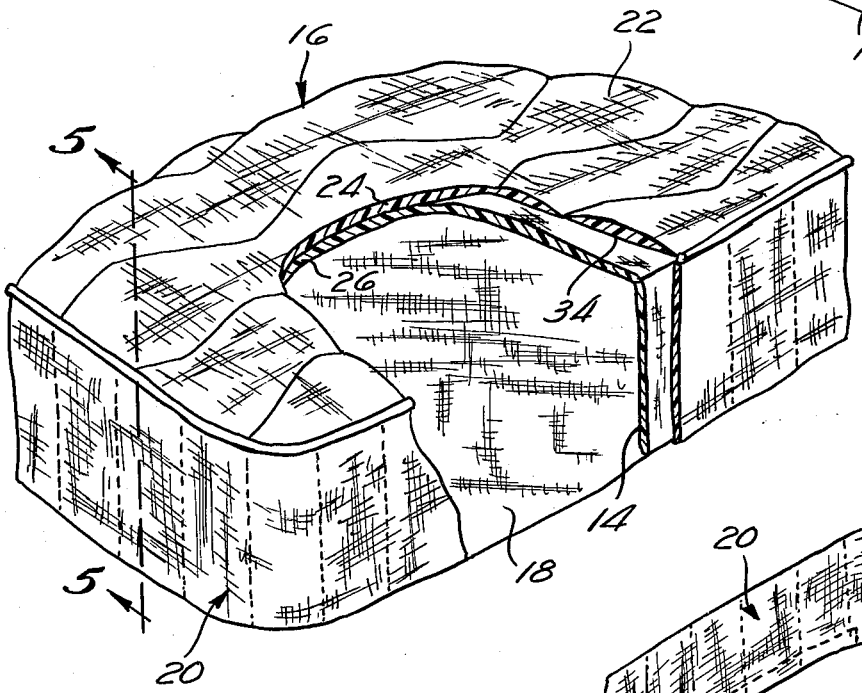
FIG. 3 is an enlarged, cut-away corner section of a mattress enclosed by the mattress cover of this invention.
Figure 4:
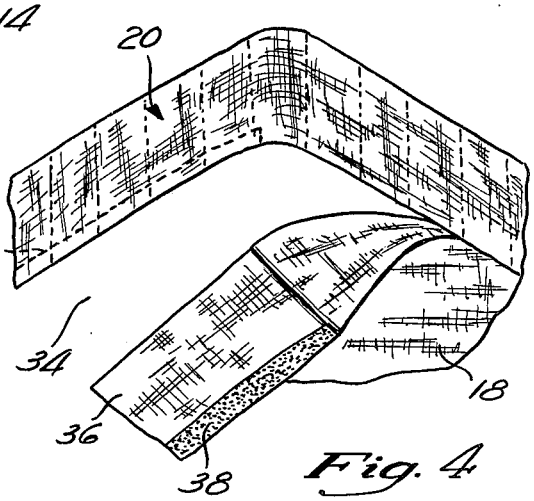
FIG. 4 is an isometric view of a portion of the mattress cover of this invention showing the access opening into the internal compartment of the mattress cover and the releasable fastening means employed adjacent the access opening.
Figure 5:
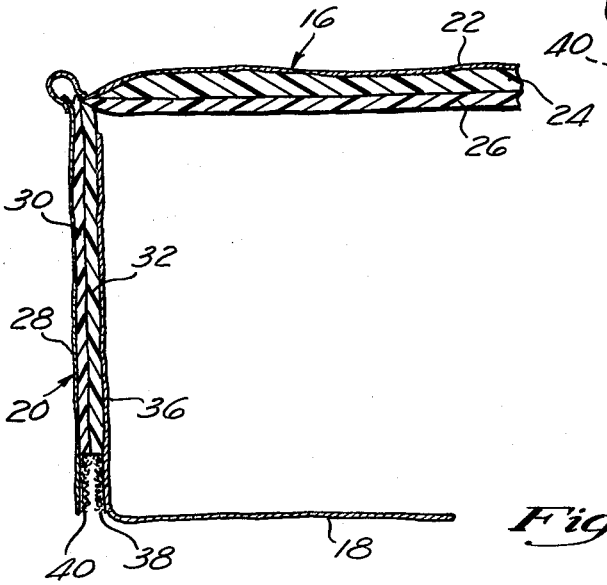

FIG. 5 is a cross-sectional view taken along line 5—5 of FIG. 3.

DETAILED DESCRIPTION OF THE SHOWN EMBODIMENT

Referring particularly to the drawing, there is shown the mattress assembly 10 incorporating the mattress cover 12 of this invention located about a conventional inflated inflatable air mattress 14. The air mattress 14 is to be constructed of plastic and is to include an appropriate air inlet valve (not shown). When the mattress 14 is inflated, it assumes a rectangular configuration depicted within the drawing.

The mattress cover 12 is constructed of a top surface 16, a bottom surface 18 which are connected by an enclosing side wall assembly 20. Top layer 16 is constructed of an outer layer 22, a middle layer 24 and an inner layer 26. The layers 22, 24 and 26 are fixed together as be sewing. The layer 22 comprises a decorative fabric. The layer 24 comprises a cushiony material with a preferable type of cushiony material being a dacron urethane foam.

The material of construction for the layer 26 requires that it has certain qualities such as it must be soft, it must be smooth and it must be non-abrasive. Since it is going to be layer 26 that is going to be in contact with the mattress 14, the selection of this material is critical. The non-abrasive qualitity is so as to minimize wear between the layer 26 and the mattress 14. Also, an abrasive material will tend to create noise. Therefore, by having the material to be smooth and soft, the creation of noise is eliminated and also the possibility of damage to the mattress 14 is eliminated. A preferable material for the layer 26 would be a thin sheet of polyester fabric. It is to be understood that the layers 22, 24 and 26, as previously mentioned, are sewn together and will normally be sewn in the manner which is termed to be quilted.

The side wall construction 20 is also composed of an exterior layer 28, a middle layer 30, and an interior layer 32. The layer 28 is identical to the layer 22. It is desirable for the side wall 20 to have a certain amount of stiffness. Therefore, the middle layer 30 takes the form of some type of stiffing material. A desirable form of stiffing material would be about a quarter inch thick fibrous mat to which is attached on one side thereof a plastic netting. This plastic netting is merely for the purpose of holding together the fibrous mat into a single structure. The fibrous mat will normally be constructed of dacron, rayon or polyester fibers.

The interior layer 32 is to have the same quality as the layer 26. This means that the layer 32 must also be non-abrasive, soft and smooth since it will be in direct contact with the mattress 14. It has been found that the desirable form of material for the layer 32 is a plastic cushiony sheet foam. It is to be understood that the layers 28, 30 and 32 are connected together as by sewing.

The material of construction for the bottom layer 18 is to be such that it is to be non-abrasive so as to not be damaging to the mattress 14, and also, since the layer 18 is going to be placed on a supportive surface, such as a tile floor, the material 18 whould have a certain amount of frictionally grabbing qualities so as to tend to prevent slipping of the mattress assembly 10 on the supportive surface. A desirable form of the material 18 would be a rayon acetate or a polyester material. The texture of the material and the weave of the material is selected so as to achieve the aforementioned qualities.

To facilitate the location of the mattress 14 within the internal compartment 34 of the bed cover 12, there is provided an access opening adjacent one edge of the side wall assembly 20. This internal compartment 24 is to be closable in part by means of a flap 36 which is merely an extension of the material 18. The flap 36 is to be located against the layer 32. It is to be understood that the flap 36 is only along one of the four edges of the rectangularly shaped side wall assembly 20.

Attached exteriorly to the flap 36 is a first fastening strip 38. A second fastening strip 40 is mounted on the interior surface of the layer 28. The fastening strip 38 will comprise a mass of small hooks with the fastening strip 40 comprising a mass of small eyelets (or vice versa). This type of fastening means is well known and is frequently sold under the Tradename of "VELCRO". It is to be understood that the fastening means is to be employed to keep the bed cover 12 tightly about the mattress 14.

It is also to be understood that different types of fastening means could be employed in lieu of the hook and eye fastening strips 38 and 40. Such conventional fastening means such as snaps, zippers, and the like could be readily employed.

What is claimed is:

1. In combination with an inflatable air mattress, a cover for said inflatable air mattress comprising:

an enclosed housing having an internal compartment, said air mattress being located within said internal compartment, said housing being constructed of a top layer and a bottom layer connected by a side wall assembly;

said top layer being constructed of a plurality of layers of material comprising at least an outer layer and an inner layer comprising a soft fabric of quilted material, said inner layer to be located against said mattress, said inner layer to be constructed of a soft fabric having a smooth interior surface to eliminate the creating of noise between said mattress and said top surface during usage, said middle layer comprising a cushiony material;

said housing having an access opening to permit entry and removal of said inflatable air mattress with respect to said internal compartment, said access opening being closable by a releasable fastening means;

said bottom layer being constructed of a frictionally grabbing material to eliminate slippage of said cover and said contained mattress upon the surface upon which it has been placed; and said side wall assembly being constructed of a first layer of material and a second layer of material and a third layer of material, said first layer of material being in contact with said mattress, said first layer of material being soft and cushiony, said second layer of material being relatively stiff and comprises about a quarter inch thick fibrous material to which is attached on one side thereof a plastic netting, said third layer of material being the most exterior and comprising a decorative fabric, said first layer and said second layer and said third layer of material being secured together.

* * * * *

UNITED STATES PATENT AND TRADEMARK OFFICE

CERTIFICATE OF CORRECTION

PATENT NO. : 4,317,244

DATED : March 2, 1982

INVENTOR(S) : Gordon A. Balfour-Ritchie

It is certified that error appears in the above-identified patent and that said Letters Patent is hereby corrected as shown below:

On the title page, inventor should read

-- Gordon A. Balfour-Ritchie --.

Signed and Sealed this

*Third* Day of *August 1982*

[SEAL]

*Attest:*

GERALD J. MOSSINGHOFF

*Attesting Officer*

*Commissioner of Patents and Trademarks*